US006546966B2

(12) United States Patent
Christe

(10) Patent No.: US 6,546,966 B2
(45) Date of Patent: Apr. 15, 2003

(54) APPARATUS FOR MAKING AVAILABLE A LENO THREAD FOR A WEAVING MACHINE

(75) Inventor: Marcel Christe, Rueti (CH)

(73) Assignee: Sulzer Textil AG, Rueti (CH)

( * ) Notice: Subject to any disclaimer, the term of this patent is extended or adjusted under 35 U.S.C. 154(b) by 0 days.

(21) Appl. No.: 10/044,093

(22) Filed: Jan. 11, 2002

(65) Prior Publication Data

US 2002/0148524 A1 Oct. 17, 2002

(30) Foreign Application Priority Data

Mar. 27, 2001 (EP) ..... 01810308

(51) Int. Cl.[7] ..... D03D 41/00

(52) U.S. Cl. ..... 139/450; 139/1 R; 139/11; 139/55.1

(58) Field of Search ..... 139/450, 11, 1 R, 139/55.1

(56) References Cited

U.S. PATENT DOCUMENTS

| | | | | |
|---|---|---|---|---|
| 2,703,587 A | * | 3/1955 | Allenson | 139/50 |
| 3,880,199 A | | 4/1975 | Riha et al. | |
| 4,365,652 A | | 12/1982 | Koch et al. | |

FOREIGN PATENT DOCUMENTS

| | | |
|---|---|---|
| DE | 28 29 689 | 1/1980 |
| EP | 1 052 317 | 11/2000 |
| GB | 1195466 | 6/1990 |
| JP | 59-26544 | 2/1984 |

* cited by examiner

*Primary Examiner*—A. Vanatta
*Assistant Examiner*—Robert H. Muromoto
(74) *Attorney, Agent, or Firm*—William Michael Hynes; Townsend and Townsend and Crew, LLP

(57) ABSTRACT

The apparatus (1) for making available a leno thread (2*a*, 3*a*) for a weaving machine comprises a shaft (4) which is rotatably journalled about an axis of rotation (A). This apparatus has an active connection to a drive apparatus (5) in order to set the shaft (4) into rotation, and comprises a holder apparatus (6) for accommodating a leno thread bobbin (2, 3), with the holder apparatus (6) being rotatably connected to the shaft (4). There is included a holder means (7) for the substantially rotation-free holding of the holder apparatus (6), and a thread guiding element (8) which is firmly connected to the shaft (4). The holder apparatus (6) is designed for the accommodation of at least two leno thread bobbins (2, 3). The shaft (4) has a thread guiding passage (4*a*) which opens towards the holder apparatus (6) and which is designed in such a manner that both leno threads (2*a*, 3*a*) passing through the thread guiding passage (4*a*) can be supplied to the thread guiding element (8).

12 Claims, 5 Drawing Sheets

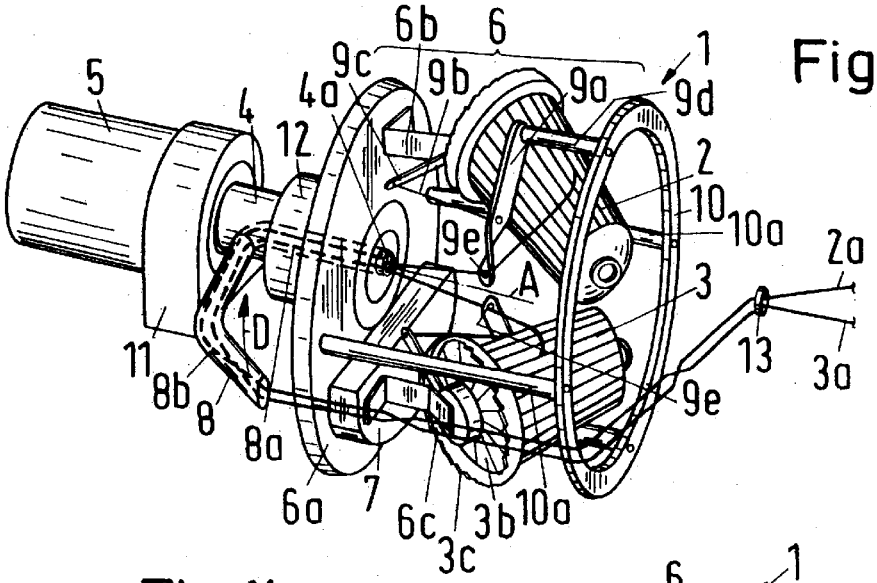
Fig.1a
Fig.1b
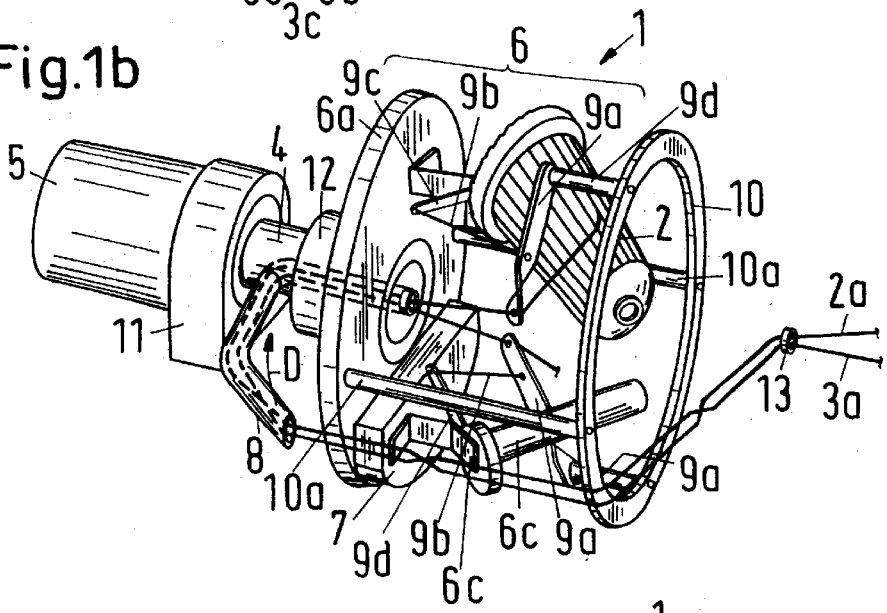
Fig.1c
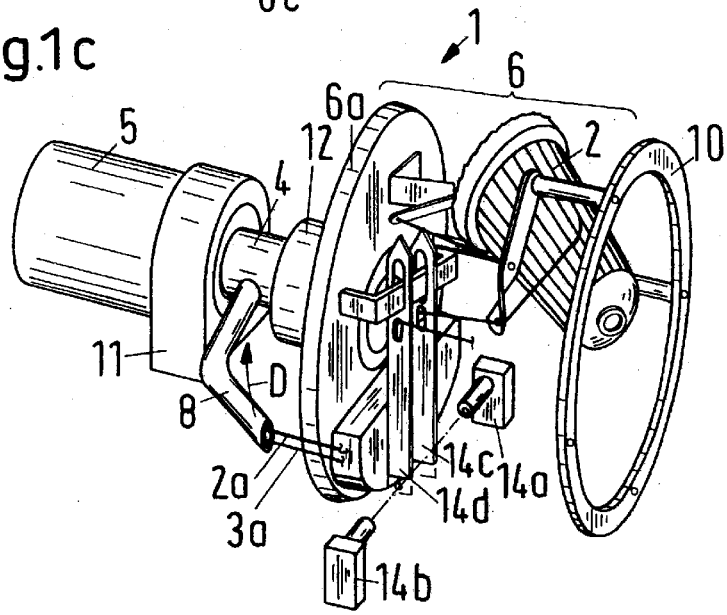

APPARATUS FOR MAKING AVAILABLE A LENO THREAD FOR A WEAVING MACHINE

BACKGROUND OF THE INVENTION

The invention relates to an apparatus for making available or dispensing a leno thread for a weaving machine.

An apparatus for making available a leno thread is known from the patent specification EP 1 052 317 A1. Disadvantageous in this apparatus is the fact that a large amount of space is required and that during the drawing off of the leno thread a plurality of windings sometimes come off at the same time.

SUMMARY OF THE INVENTION

The object of the present invention is to propose an advantageous apparatus for making available a leno thread.

This object is satisfied in particular by an apparatus for making available a leno thread for a weaving machine, comprising a shaft which is rotatably journalled about an axis of rotation and which has an active connection to a drive apparatus in order to set the shaft into rotation, and comprising a holder apparatus for accommodating a leno thread bobbin, with the holder apparatus being rotatably connected to the shaft, and comprising a holder means for the substantially rotation-free holding of the holder apparatus, and comprising a thread guiding element which is firmly connected to the shaft, with the holder apparatus being designed for the accommodation of at least two leno thread bobbins and with the shaft having a thread guiding passage which opens towards the holder apparatus and which is designed in such a manner that both leno warp threads passing through the thread guiding passage can be introduced to the thread guiding element.

The apparatus in accordance with the invention has the advantage that both leno thread bobbins are arranged in the same holder apparatus, which enables a short and compact constructional form. In a preferred embodiment the apparatus in accordance with the invention is designed for the accommodation of two leno thread bobbins. This apparatus can however have more than two holder apparatuses for leno thread bobbins. In a preferred embodiment the apparatus for preparing the leno threads has a thread guiding passage which opens into the center of the holder apparatus, via which all leno threads are drawn off. The thread guiding passage is followed by a thread guiding element which is journalled so as to be capable of being driven and rotated through 360° about an axis of rotation. The design of the thread guiding element and the direction of the path of the leno threads is such that the leno threads are drawn off from the leno thread bobbins via the thread guiding passage and the leno threads are then supplied to the weaving machine while circulating outwardly about the holder apparatus. This circulatory movement leads to a mutual twisting of the leno threads which are drawn off from the leno thread bobbins. A thread twisting element is also subsequently provided which supplies the mutually twisted leno threads to a following weaving machine in synchronism with its working cycle, so that a leno edge or a leno binding respectively can be produced in the cloth. The apparatus in accordance with the invention enables a complete leno binding to be produced.

One advantage of the apparatus in accordance with the invention is the fact that the holder apparatus for the leno thread bobbins is designed to be stationary or substantially stationary. This enables the apparatus in accordance with the invention to be operated with a very high speed of rotation as well. In addition the movably journalled thread guiding element can be designed to be very light, i.e. to have low mass, which in addition to a high speed of rotation also permits a rapid moving out and braking of the thread guiding element.

The invention will be described with reference to a plurality of exemplary embodiments.

BRIEF DESCRIPTION OF THE DRAWINGS

FIG. 1*a* is a perspective view of an apparatus for the preparation of leno threads;

FIG. 1*b* is a perspective view of an apparatus in accordance with FIG. 1*a* with only one leno thread bobbin being shown;

FIG. 1*c* is a perspective view of an apparatus for the preparation of leno threads with sensor elements;

DESCRIPTION OF THE PREFERRED EMBODIMENTS

Figure 2:
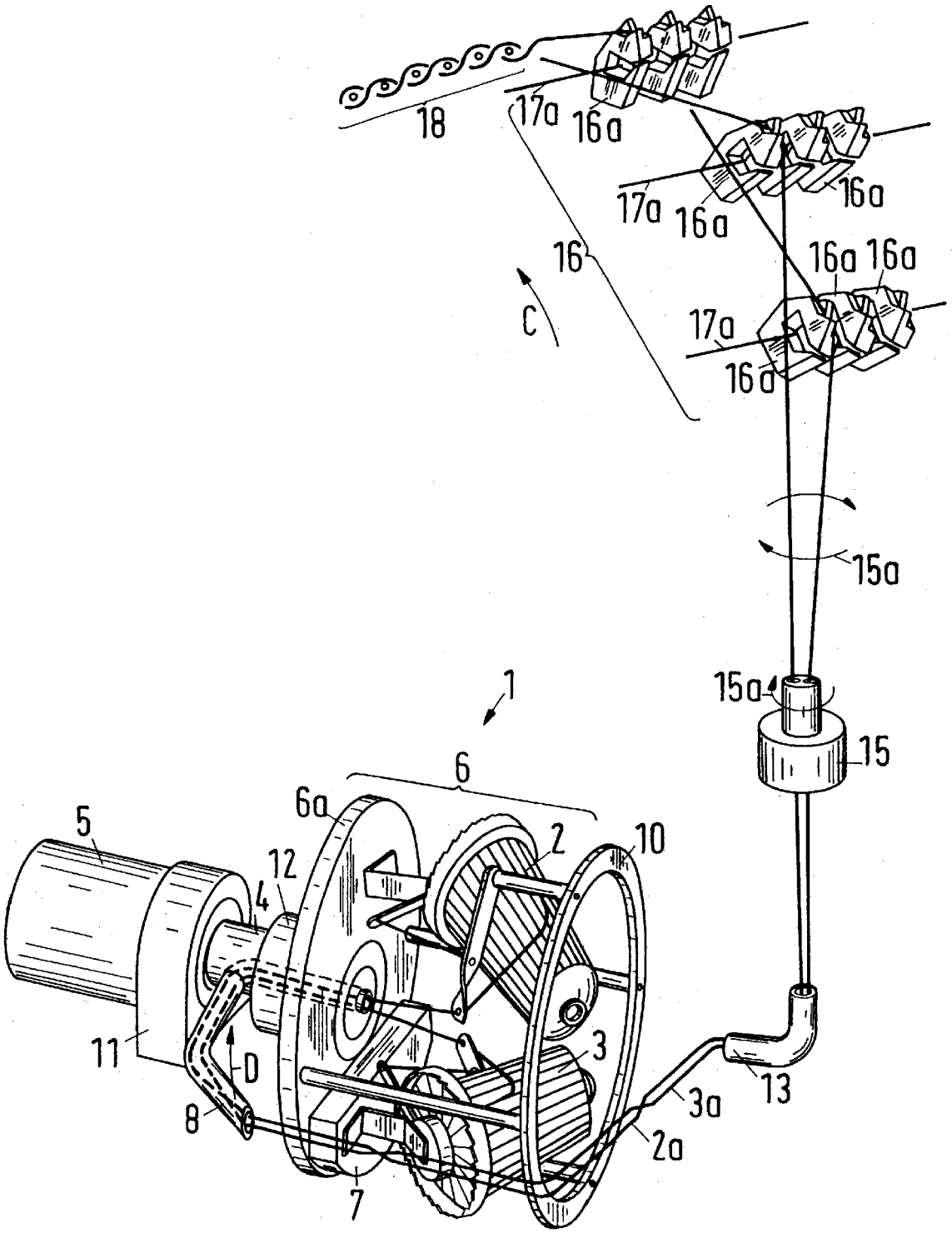
FIG. 2 shows the apparatus which is illustrated in FIG. 1*a* in combination with a thread twisting apparatus in connection with a series shed weaving machine.

In the following figures identical objects will be provided with identical reference symbols, so that these objects need not be explained anew with each figure.

FIG. 1*a* shows an apparatus 1 for making available two leno threads 2*a,* 3*a* for a non-illustrated weaving machine which is placed afterwards in the direction of travel of the leno threads 2*a,* 3*a*. The apparatus 1 comprises a holder apparatus 6 with a circular base plate 6*a* at which a first holder apparatus 6*b* and a second holder apparatus 6c are arranged for holding one leno thread bobbin 2, 3 each. A shaft 4 is rotatably journalled about an axis of rotation A with the help of a bearing 11. The shaft 4 is journalled so as to be drivable in the direction of rotation D via a drive apparatus 5, which is designed as an electric motor in the illustrated exemplary embodiment. The holder apparatus 6 is rotatably journalled with respect to the shaft 4 via a bearing 12. The holder apparatus 6 comprises a holder means 7 which is designed as an eccentrically arranged weight. This weight, in combination with the bearing 12, prevents the holder apparatus 6 from rotating when the shaft 4 rotates about the axis of rotation A. Since the holder apparatus 6 is rotatably journalled with respect to the shaft 4, it can sometimes happen that the holder apparatus 6 for example executes a slight pendulum or oscillating movement about the axis of rotation A. The shaft 4 is journalled in fixed position in the bearing 11, so that the holder apparatus 6 is also held stationarily or substantially rotationlessly with the exception of the possible pendulum movement. A thread guiding passage 4*a* is arranged. in the center of the circular base plate 6*a*. This thread guiding passage 4*a* forms part of a thread guiding element 8 which is of U-shaped design and which is firmly connected to the shaft 4 and therefore executes a movement in the direction of rotation D about the axis of rotation A. The leno threads 2*a,* 3*a* are drawn off travelling in the direction of the axis of rotation A inside the shaft 4, are guided by the thread guiding element 8 to the periphery of the holder apparatus 6 and are drawn off towards the eye 13 circulating about the holder apparatus 6. The rotational movement D of the thread guiding element 8 causes mutual twisting of the two leno threads 2*a,* 3*a*. A guide element 10 which serves to reliably guide the leno threads 2*a,* 3*a* outwardly around the holder apparatus 6 is arranged extending parallel to the base plate 6a and spaced from the latter in the direction of extent of the axis of rotation A.

For each leno thread bobbin 2, 3 the holder apparatus 6 comprises a thread guidance means 9*a,* 9*b* with an eye 9*e* in order to draw off the leno thread 2*a,* 3*a* at a predetermined point guided by the leno thread bobbin 2, 3. In the illustrated exemplary embodiment the thread guidance means 9*a* is connected via a retainer element 9*d* to the guide element 10. A braking means 9*c* is resiliently connected to the first holder apparatus 6*b* or to the second holder apparatus 6*b*. In addition the braking means 9*c* is connected to the thread guidance means 9*a* via a connection means 9*b,* which is designed as a cord. The leno thread bobbin 2, 3 is journalled on a carrier 3*b,* which has a sawtooth-shaped structure at its lower side 3*c* which cooperates in such a manner with the braking means 9*c* that the leno thread bobbin 2, 3 is journalled so as to be rotatable in the one direction of rotation and has a self-inhibiting blocking in the opposite direction. In addition the cooperation of the braking means 9*c* and the sawtooth-shaped lower side 3*c* also causes a braking action during the rotation of the leno thread bobbin 2, 3 in the draw-off direction. Through the coupling of the thread guidance means 9*a* with the braking means 9*c* the braking action also depends on the position of the thread guidance means 9*a*.

FIG. 1*b* shows the same apparatus 1 as is illustrated in FIG. 1*a*, with only one leno thread bobbin 2 being shown in the holder apparatus 6, so that the second holder apparatus 6*c,* in which the leno thread bobbin 3 is not illustrated, can be recognized in detail.

FIG. 1*c* shows an apparatus 1 for making available a leno thread 2*a,* 3*a* which has sensors 14*a,* 14*b,* 14*c,* 14*d* for monitoring a breakage of the leno threads 2*a,* 3*a*. Two warp thread monitor lamella 14*c,* 14*d* are journalled at the circular base plate 6*a* so as to be movable in the vertical direction. In the event of a breakage of a leno thread 2*a,* 3*a* the corresponding thread monitor lamella 14*c,* 14*d* falls downwards and interrupts the light beam between the transmitter 14*a* and the receiver 14*b*. Thus a breakage can be detected.

FIG. 2 shows the apparatus 1 which is shown in FIG. 1*a* in conjunction with a series shed weaving machine. A plurality of shed forming elements 16*a* are arranged adjacently on a weaving rotor 16 in the direction of travel of the weft thread 17*a* and parallel to one another with spacing in the direction of rotation C. The leno threads 2*a,* 3*a* are supplied via an eye 13, which is also designed as a deflection element, to a thread twisting element 15 which rotates synchronously with the thread guiding element 8 in the direction of rotation 15*a*. The thread twisting element 15 is excited in such a manner that the leno threads 2*a,* 3*a* are successively laid in into a respective upper or lower shed of the shed holder elements 16*a,* whereupon a weft thread 17*a* is inserted into the weaving rotor 16 and thereby a leno binding 18 is produced in the manufactured cloth, for example in the cloth edge region.

Figure 3B:
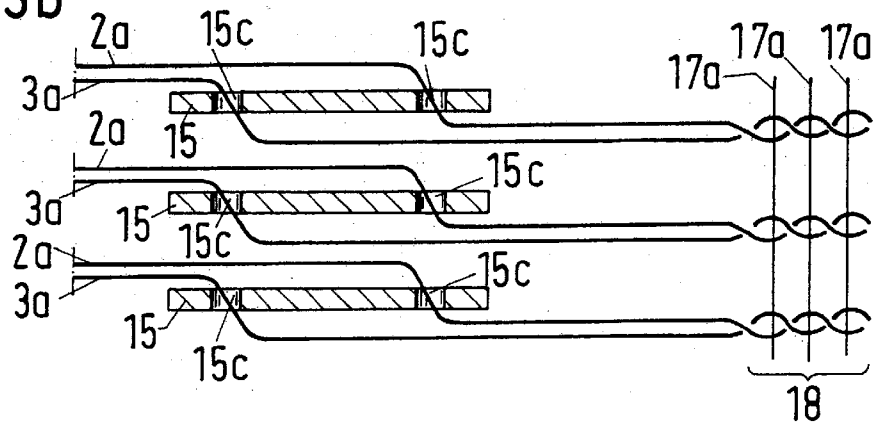
FIG. 3*b* shows a plan view of three adjacently arranged thread twisting apparatuses in accordance with FIG. 3*a;*
Figure 3A:
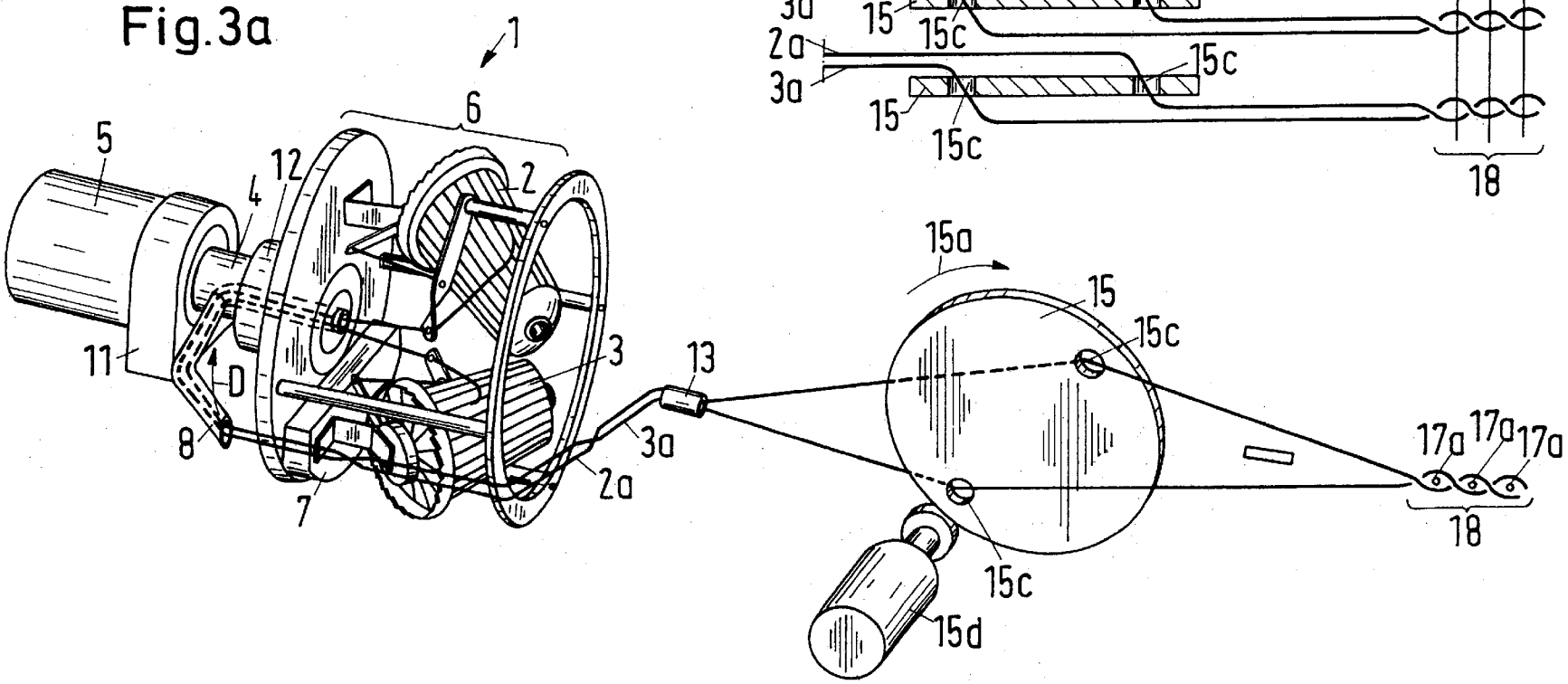
FIG. 3*a* shows the apparatus which is illustrated in FIG. 1*a* in combination with a thread twisting apparatus in connection with a flat weaving machine.

FIG. 3*a* shows the apparatus 1 which is illustrated in FIG. 1*a* in combination with a further thread twisting element 15. A disc-shaped thread twisting element 15 with apertures 15*c* which is rotatably driven via a drive apparatus 15*d* in the direction of rotation 15*a* is arranged after the eye 13. This driving again takes place synchronously with the rotation of the thread guiding element 8. Arranged following the thread twisting element 15 is a flat weaving machine in which a cloth 18 is produced with a leno binding, for instance in the edge region.

FIG. 3*b* shows in a plan view three thread twisting elements 15 which are arranged adjacently with spacing and which are each supplied with leno warp threads 2*a,* 3*a* by a non-illustrated apparatus 1. This arrangement enables a cloth with three adjacently extending leno bindings to be produced. Any desired number of thread twisting elements 15 of this kind could be arranged next to one another.

Figure 4:
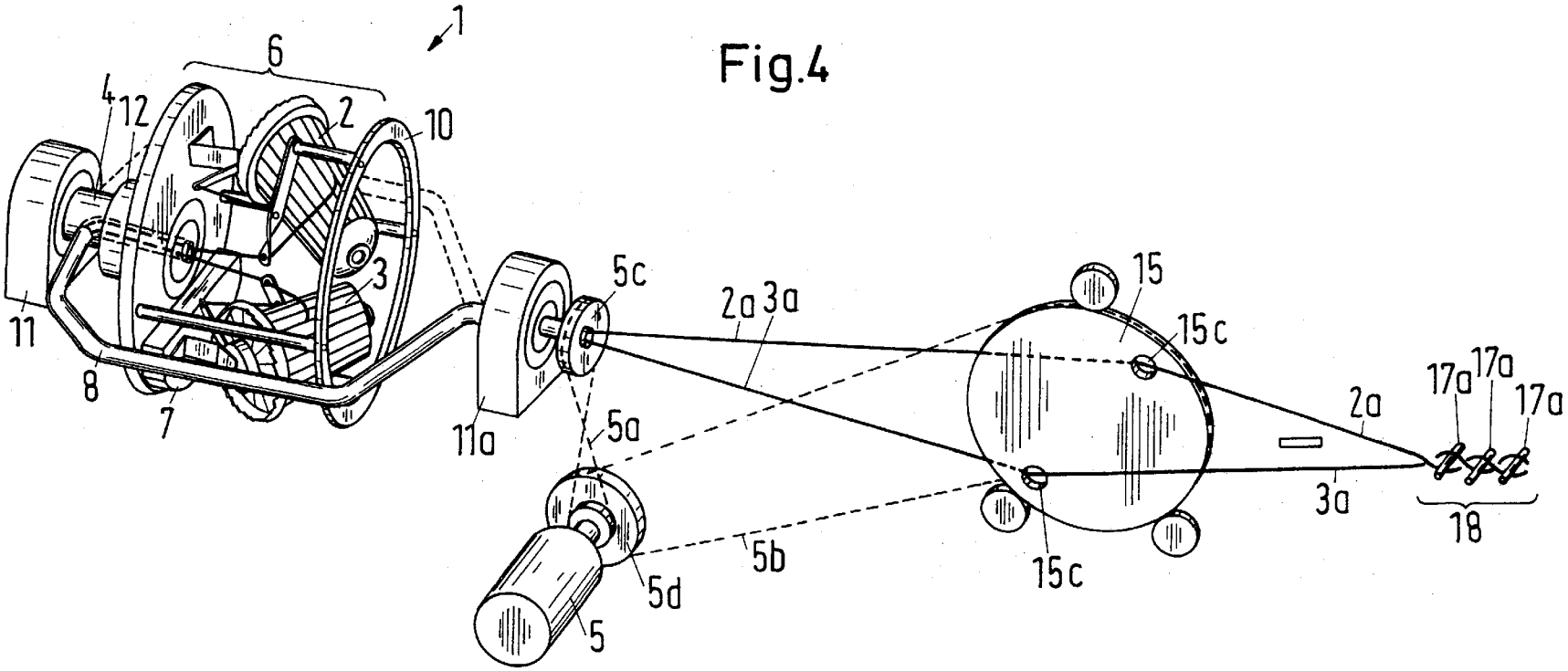
FIG. 4 is a perspective view of a further apparatus for preparing leno threads with a thread twisting apparatus.

FIG. 4 shows a further exemplary embodiment of an apparatus 1 for making available a leno thread 2*a,* 3*a*. In contrast to the embodiment which is illustrated in FIG. 1*a* this apparatus 1 has a thread guiding element 8 which is rotatably journalled in a first bearing 11 and in a second bearing 11*a*. In addition, starting from the shaft 4, the thread guiding element 8 forms a through-going thread guiding passage, which has an outlet opening for releasing the leno thread 2*a,* 3*a* only after the second bearing 11*a*. A disc 5*c* is rotationally fixedly connected to the thread guiding element 8. A common drive apparatus 5, an electric motor, drives the disc 5*c* via a disc 5*d* and a transmission 5*a* and drives the thread twisting element 15 which was already described in connection with FIG. 3*b* via a transmission 5*b*. The thread guiding element 8 is also driven via the disc 5*c,* so that the drive apparatus 5 is sufficient in order to drive the entire apparatus 1 for preparing the leno threads 2*a,* 3*a* in order to form the leno binding 18.

Figure 5A:
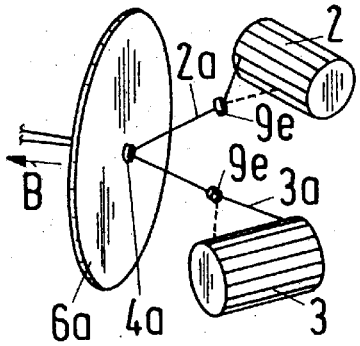
FIGS. 5*a,* 5*b,* 5*c* and 5*d* show various arrangements of the leno thread bobbins in the holder apparatus.
Figure 5B:
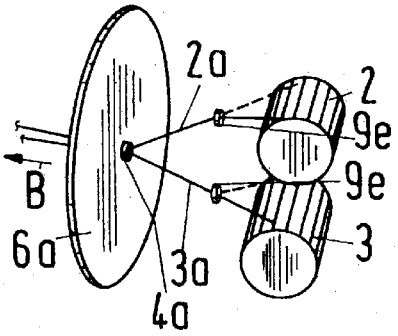
Figure 5C:
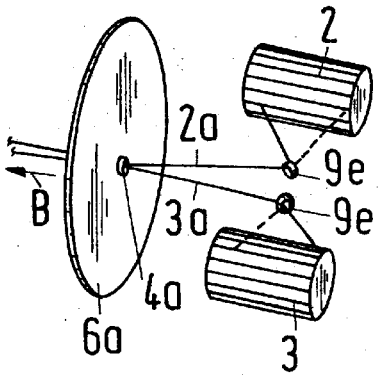
Figure 5D:
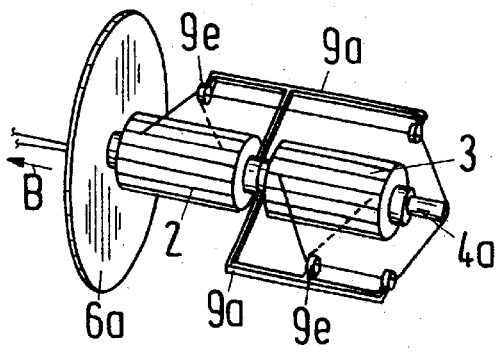

FIGS. 5*a,* 5*b,* 5*c* and 5*d* show different arrangements of the leno thread bobbins 2, 3 in the holder apparatus 6. The thread guiding passage 4*a* is in each case arranged in the circular base plate 6*a*. The first and the second holder apparatus 6*b,* 6*c* for the leno thread bobbins 2, 3 and the eyes 9*e* are preferably arranged to be mutually matched in the holder apparatus 6 in such a manner that the leno thread 2*a,* 3*a* is drawn off substantially perpendicularly to the surface of the leno thread bobbin 2, 3 or substantially perpendicularly to the axis of rotation of the leno thread bobbin 2, 3 respectively. FIGS. 5*a,* 5*b,* 5*c* and 5*d* show different arrangements of leno thread bobbins 2, 3 and eyes 9*e,* which are mutually arranged in such a manner that the leno thread 2*a,* 3*a* is drawn off approximately perpendicularly or tangentially respectively. This geometrical arrangement has the advantage that the leno thread 2*a,* 3*a* can be reliably drawn off from the leno thread bobbin 2, 3.

The leno thread 2*a,* 3*a* can also be designated as a leno warp thread.

In all illustrated exemplary embodiments the holder apparatus 6 is secured against a rotation via a holder means 7 which is designed as an eccentrically arranged weight. This holder means 7 could for example also be designed with permanent magnets which are distributed in the peripheral direction of the circular base plate 6*a,* with a second set of permanent magnets surrounding the circular base plate 6*a* in the peripheral direction while forming a gap. This second set of permanent magnets is fixedly arranged and is arranged with respect to the first set in such a manner that a rotation of the first set, i.e. a rotation of the holder apparatus 6, is prevented. The leno threads 2*a,* 3*a* extend through the gap. In this manner a holder apparatus 6 can be formed which is held by magnetically acting forces.

What is claimed is:

1. Apparatus (1) for making available a leno thread (2*a*, 3*a*) for a weaving machine comprising:

a shaft (4) which is rotatably journalled about an axis of rotation (A) having an active connection to a drive apparatus (5) in order to set the shaft (4) into rotation;

a holder apparatus (6) for accommodating a leno thread bobbin (2, 3) with the holder apparatus (6) being rotatably connected to the shaft (4);

a holder means (7) for the substantially rotation-free holding of the holder apparatus (6);

a thread guiding element (8) connected to the shaft (4) for rotation with the shaft (4);

at least two leno thread bobbins (2, 3) accommodated in the holder apparatus (6); and, the shaft (4) having a thread guiding passage (4*a*) which opens towards the holder apparatus (6) enabling both leno warp threads (2*a*, 3*a*) to pass from the leno thread bobbins (2, 3) through the thread guiding passage (4*a*) to be supplied to the thread guiding element (8).

2. Apparatus in accordance with claim 1, wherein:

the thread guiding element (8) enables the leno warp threads (2*a*, 3*a*) to be guided around and outside the leno thread bobbins (2, 3).

3. Apparatus in accordance with claim 1, wherein:

the thread guiding element (8) is substantially U-shaped and has first and second limbs (8*a*, 8*b*); and, one limb (8*a*) extends inside the shaft (4) in the direction of the axis of rotation (A).

4. Apparatus in accordance with claim 1, wherein:

the holder apparatus (6) comprises a circular base plate (6*a*) arranged perpendicularly to the axis of rotation (A); and, a circular guide element (10) is arranged coaxially to the axis of rotation (A) with a spacing in the direction of extent of the axis of rotation (A) with respect to the base plate (6*a*).

5. Apparatus in accordance with claim 4, wherein:

the guide element (10) is designed to be matched with respect to the leno thread bobbins (2, 3); and, the thread bobbins (2, 3) are to be accommodated in the holder apparatus (6) in such a manner that the guide element (10) protrudes in the direction radial to the axis of rotation (A) beyond the leno thread bobbins (2, 3).

6. Apparatus in accordance with claim 1, further comprising:

one eye (13) for guiding the leno warp threads (2*a*, 3*a*) in the region of the axis of rotation (A), the one eye having a spacing with respect to the holder apparatus (6) to enable the eye (13) to project in the direction of extent of the axis of rotation (A) beyond the leno thread bobbins (2, 3).

7. Apparatus in accordance with claim 1, wherein:

the shaft (4) is rotatably journalled in a securable bearing (11).

8. Apparatus in accordance with claim 1, wherein the holding device (6) further comprises:

a thread guidance means (9*a*) which is arranged relative to the positioning of an inserted leno thread bobbin (2, 3) to enable the leno threads (2*a*, 3*a*) to be drawn off from the leno thread bobbin (2, 3) substantially perpendicularly to the longitudinal extent of the leno thread bobbins.

9. Apparatus in accordance with claim 1, wherein the holder apparatus (6) further comprises:

a sensor (14*a*, 14*b*, 14*c*, 14*d*) which permits a breakage of a leno thread (2*a*, 3*a*) to be detected.

10. Apparatus in accordance with claim 1, wherein the holder apparatus (6) further comprises:

a thread guidance means (9*a*) for guiding the leno thread (2*a*, 3*a*) when drawn off from the leno thread bobbin (2, 3); and, a braking means (9*c*) acting on the leno thread bobbins (2, 3), the braking means connected to the thread guidance means (9*a*) to cause a braking torque on the leno thread bobbins (2, 3) dependent on the position of the thread guidance means (9*a*) .

11. Apparatus in accordance with claim 1, further comprising:

a thread twisting element (15) driven to rotate synchronously to the thread guiding element (8), the thread twisting element (15) being arranged after the thread guiding element (8) in the draw-off direction of the leno warp threads (2*a*, 3*a*).

12. Apparatus in accordance with claim 1, further comprising:

a weaving machine for receiving the leno threads for weaving cloth.

* * * * *